US009027792B2

(12) United States Patent
Watts

(10) Patent No.: US 9,027,792 B2
(45) Date of Patent: May 12, 2015

(54) BEER DISPENSING DEVICE AND SYSTEM

(76) Inventor: Larz Watts, San Diego, CA (US)

( * ) Notice: Subject to any disclaimer, the term of this patent is extended or adjusted under 35 U.S.C. 154(b) by 0 days.

(21) Appl. No.: 13/640,030

(22) PCT Filed: Apr. 12, 2011

(86) PCT No.: PCT/US2011/000666

§ 371 (c)(1),
(2), (4) Date: Oct. 8, 2012

(87) PCT Pub. No.: WO2011/129884

PCT Pub. Date: Oct. 20, 2011

(65) Prior Publication Data

US 2013/0056495 A1 Mar. 7, 2013

Related U.S. Application Data

(60) Provisional application No. 61/323,180, filed on Apr. 12, 2010.

(51) Int. Cl.

| | |
|---|---|
| ***B67D 7/80*** | (2010.01) |
| ***B67D 1/08*** | (2006.01) |
| ***B67D 1/04*** | (2006.01) |

(52) U.S. Cl.

CPC ..... *B67D 1/0857* (2013.01); *B67D 1/0406* (2013.01); *B67D 1/0412* (2013.01)

(58) Field of Classification Search

CPC .. B67D 1/0406; B67D 1/0412; B67D 1/0857; B67D 1/06; F25D 31/002

USPC ..... 222/80–83, 83.5, 145.1, 180, 181.1

See application file for complete search history.

(56) References Cited

U.S. PATENT DOCUMENTS

| | | | | |
|---|---|---|---|---|
| 1,990,325 | A * | 2/1935 | Hopkes | 62/390 |
| 2,092,320 | A * | 9/1937 | Lueck | 62/399 |
| 2,506,840 | A * | 5/1950 | Pique | 62/339 |
| 3,159,190 | A * | 12/1964 | Skiera et al. | 141/369 |
| 3,865,276 | A * | 2/1975 | Thompson | 222/146.6 |
| 4,225,059 | A * | 9/1980 | Kappos | 222/146.6 |
| 4,437,319 | A * | 3/1984 | Iannelli | 62/138 |
| 4,869,396 | A | 9/1989 | Horino et al. | |
| 5,009,082 | A * | 4/1991 | Abraham, III | 62/390 |
| 5,016,786 | A | 5/1991 | Horino et al. | |
| 5,129,552 | A * | 7/1992 | Painchaud et al. | 222/146.6 |
| 5,564,602 | A | 10/1996 | Cleland et al. | |
| 6,105,825 | A * | 8/2000 | Gomi et al. | 222/146.6 |

(Continued)

*Primary Examiner* — Paul R Durand
*Assistant Examiner* — Jeremy W Carroll
(74) *Attorney, Agent, or Firm* — Miller Nash Graham & Dunn LLP; Chandra E. Eidt

(57) ABSTRACT

The present invention provides an easy to use, convenient, compact, energy efficient, labor efficient, cost-effective, fast, safe, neat, electricity-independent, self-contained, portable beer dispensing device and system that uses CO2 or other acceptable gas to maintain the freshness of beer, presents a ready height and arrangement for dispensing chilled fresh beer, and can be used in a variety of professional, casual, indoor and/or outdoor settings. The present invention chills beer before it is dispensed but after it has been removed from the keg. The present invention incorporates use of a gas tank to propel beer from the keg, through the beer dispensing device and system so that the beer inside the keg will not go flat. The present invention offers a convenient arrangement of its components that simplifies its use, transport, set up, and break down. The present invention also provides a space efficient arrangement for dispensing chilled, draft beer.

19 Claims, 11 Drawing Sheets

(56) References Cited

U.S. PATENT DOCUMENTS

| | | | | |
|---|---|---|---|---|
| 6,216,914 | B1 | 4/2001 | Martucci | |
| 6,375,048 | B1 | 4/2002 | van der Meer et al. | |
| 6,641,004 | B2 | 11/2003 | Nielsen | |
| 6,745,922 | B1 | 6/2004 | Vlooswijk et al. | |
| 6,827,238 | B2 | 12/2004 | Barker et al. | |
| 7,131,560 | B2 | 11/2006 | Hammond | |
| 7,373,784 | B2 | 5/2008 | Haskayne | |
| 2008/0029543 | A1* | 2/2008 | Leufgen et al. | 222/146.6 |
| 2009/0044561 | A1* | 2/2009 | Dalton et al. | 62/398 |
| 2010/0282777 | A1* | 11/2010 | Johnson | 222/146.6 |

* cited by examiner

BEER DISPENSING DEVICE AND SYSTEM

BACKGROUND OF THE INVENTION

1. Field of the Invention

The present invention generally relates to a device and system for dispensing beverages, such as beer. More particularly, the present invention provides an easy to use, convenient, compact, energy efficient, labor efficient, cost-effective, fast, safe, neat, electricity-independent, portable beer dispensing device and system that can be used to dispense fresh chilled beer.

2. Description of Related Art

Two types of beer dispensing device systems are conventionally used to dispense beer from a keg.

The first beer dispensing device system type is a heavyweight, commercial system involving heavy pressure bottles of compressed carbon dioxide ($CO_2$) gas operating through regulators and pressure lines for pressurizing one or more kegs. While such commercial systems advantageously use $CO_2$ dispensing systems to prevent air from contacting the beer in the keg to keep the beer fresh for a longer period, such systems are expensive, large, heavy, energy-intensive, not easily transported, set up or broken down, and can be awkward and cumbersome to implement. It is not practical or suitable to utilize this first type of beer dispensing system for temporary events or social gatherings.

The second beer dispensing device system type is a small and lightweight consumer system that uses either a manually or electrically operated air pump compressor to pressurize the keg. Such consumer systems are often used at temporary events such as parties, picnics or other indoor and outdoor social gatherings.

Conventional consumer systems do not keep the beer in the keg fresh because oxygen in the air can quickly flatten the beer. Heavy pressure bottles of compressed $CO_2$ gas, such as those used in the commercial systems to keep beer fresh for a longer period of time, are not easily adapted to such consumer systems. Furthermore, the beer keg associated with these consumer systems often inconveniently and inefficiently requires that the entire keg be chilled or iced down before and during the dispensing of beer.

Conventional consumer systems typically use cooling containers, such as boxes, buckets, tubs or barrels to ice down or chill the beer keg. Problematically, however, the beer lines attached to the keg are often outside of these cooling containers such that the beer in these lines is subject to undesirable warming. External beer lines attached to kegs in cooling containers also present a safety hazard as they can fall off and/or become disconnected when people step on, kick, and/or trip over the external beer lines as they travel to, from, and around the keg. The cooling containers themselves are large, often unattractive, and typically sit on the ground or on a table. Furthermore, cooling containers can become very heavy when full and often inconveniently involve the need to dump out large amounts of water and ice during and/or after use.

One example of a conventional consumer system, often referred to as a "jockey box," is a portable beer dispensing device that can dispense beer without electrical power, typically chills the beer with ice and water, and uses $CO_2$ to propel the beer through a stainless steel coil arrangement and out of a beer faucet. Kegs used with jockey boxes are typically kept cold separately using a cooling container. A typical jockey box set up is made up of one or more kegs, a cooler with a hinged lid on the top, a stand alone $CO_2$ tank, $CO_2$ lines that run from the $CO_2$ tank to the keg or kegs of beer, one or two keg couplers, beer line(s) that run from the keg or kegs through a side of the cooler, and one or two stainless steel coils (depending on if it is a single faucet or dual faucet model) that are situated within the cooler to receive beer from the beer line(s). $CO_2$ pressure is used to propel beer from the keg, via the keg coupler, through the beer line, through the back wall of the cooler, through a stainless steel coil that is surrounded with ice and water in the cooler, then out through the cooler wall, at which point the beer is dispensed through a beer faucet. The length of the stainless steel coil depends on the jockey box style. However, 80 feet of coil per faucet is recommended for lighter volume use while 120 feet of stainless steel coils per faucet is recommended for heavier volume use.

A typical jockey box set up is a space consuming arrangement of separate parts. In addition to all the parts specified above, approximately 20 to 40 pounds of crushed or cubed ice, keg coupler(s), a cooling container for the keg, and about 1 to 3 gallons of water are also required. The cooler dimensions vary, but are typically about 3 feet to 4 feet wide by 1.5 feet to 2 feet deep and 1.5 feet to 2 feet tall. The cooler must be placed on top of a raised surface such as a table, or ledge, to achieve a comfortable pouring height. If the cooler rests on the ground, then the beer dispensing faucet(s) will be approximately 8 inches to 1 inch from the ground, thus frustrating access to the beer faucet and requiring that the user bend over almost completely to the ground to pour beer. The $CO_2$ gas tank propels the beer through the beer lines and coils and dispenses it through the faucet. The keg and the $CO_2$ tank are typically on the ground. The $CO_2$ tank can range in size from approximately 8 inches wide by 2 feet tall to, more commonly in a jockey box set up, 10 inches wide by 2 feet to 3 feet tall.

The set up and break down of a jockey box requires great effort and is undesirably laborious. For example, due to the amount of space required to mount the jockey box arrangement and size of its several parts, transportation of such a device requires a truck or a car with plenty of back seat and/or trunk space. Unloading the several large, heavy and/or cumbersome jockey box parts for set up in a new location typically requires separate carrying of each of the cooler and stainless steel coils, the $CO_2$ tank, the keg or kegs (which may be transported by a dolly or hand truck, depending on the size of the keg or kegs, which can range in weight from approximately 50 pounds to 165 pounds), one or more bags of ice, water, the cooling container(s) for the keg or kegs, and optionally a folding table, bench, stand, or the like, needed to lift the jockey box to facilitate pouring. The jockey box components, in total, may weigh anywhere from a couple hundred pounds up to about 400 pounds. While it is possible to use a hand truck or dolly to transport the other box components (in addition to the keg or kegs), such as the cooler, table, or $CO_2$ tank, etc., doing so is not recommended because the unbalanced nature of the hand truck or dolly will result in the parts being unbalanced and unsecured and could result in broken faucets or, falling or crushing hazards or, if the $CO_2$ regulator is damaged or broken off, can result in a dangerous projectile that can result in serious injury or death. This is particularly the case if these components are being transferred over uneven or bumpy ground, such as through a field, in a park, etc. Due to the many separate, large, heavy and/or cumbersome parts involved in setting up a jockey box, several time consuming, tiring, inconvenient, and possibly unsafe trips between the transport vehicle used to deliver the jockey box to a site and any set up location removed from the transport vehicle, such as a field, park, event space, etc., are required. Similarly, breaking down the jockey box requires repeating the same actions again, albeit in different order.

Assembly of a jockey box typically requires the following several steps. An appropriately strong and secure table or bench, etc. must be set up, upon which the keg or kegs is/are securely placed. The beer line is connected at one end through the cooler wall to the stainless steel coil and the other end is connected to the keg coupler that is subsequently connected to the keg. The $CO_2$ line is connected at one end to the $CO_2$ regulator that is, in turn, connected to the $CO_2$ tank. The $CO_2$ line is connected at the other end to the keg coupler. For jockey boxes with two faucets a second beer line is connected to the second set of stainless steel coils through the cooler wall and the other end of the beer line to the keg coupler on the second keg. Also, a second $CO_2$ line can be attached to a second keg coupler and, using a "T" formation with the original $CO_2$ line that is connected to the $CO_2$ regulator in order to split the flow of gas to each of the kegs. All connections must be secure prior to opening the $CO_2$ gas flow from the tank to the keg couplers. Provided that the beer faucets on the front of the jockey box are closed, the keg couplers can then be engaged by tapping the keg or kegs.

Approximately 30 ounces of beer are typically permitted to flow through the lines prior to beer service so that any residual dust, beer, or cleaning solutions from previous uses are pushed out of the lines. Once the stainless steel coils are full of beer the cooler is typically filled with ice and water, in about a 50:50 ratio. It typically takes about 10 minutes for the beer to be adequately chilled and ready to serve.

Leaks are common with the jockey box set up because of the configuration of the jockey box parts and the exposed beer line(s) and $CO_2$ line(s) running between each of the parts. These beer and $CO_2$ lines create unsafe tripping hazards and, because they are out in the open, often obtains abrasions and holes resulting in leaking beer and ultimately a foamy pour and messy beer serving area. Furthermore, beer contained in the beer lines is exposed to potentially higher temperatures which can disadvantageously result in warm beer.

Another example of a consumer system, often referred to as a "bronco pump," is a small pump (approximately 12 inches high by 2 inches to 3 inches wide) that directly connects to the keg and is manually pumped to dispense beer. Bronco pumps also require the user to place the keg in a cooling container, that is typically filled with ice to chill the keg. A bronco pump is essentially a keg coupler with a plunger style top that, when pressed down, pushes outside air into the keg and forces the beer out through a short hose (approximately 12 inches long) that has a nozzle (faucet) at the end. To effectively use a bronco pump it must be engaged with the beer keg, and the faucet opened to allow for some pressure to release and some beer foam to blow out. Once the pressure slows nearly to a stop, the handle is pumped causing the beer to flow.

Use of bronco pumps results in wasted and un-drinkable beer. Bronco pumps are also labor intensive and difficult to use. The bronco pump requires the use of both hands to hold the faucet and pump the beer, without providing support for a drinking vessel while it is being filled. Bronco pumps often dispense flat unsavory beer due to the introduction of regular air into the keg. When regular air is pumped into the keg, it immediately begins to reduce the carbonation in the beer degrading its quality, and typically causes the beer to go flat within about 24 hours. If only a portion of the keg is consumed, any remaining beer, once it has gone flat, is discarded, resulting in unnecessary waste.

As an alternative to using the cooling containers required by conventional beer dispensing systems, including the jockey boxes and bronco pumps described above, an entire keg may be placed in a refrigerator-type device, such as a kegerator, in order to cool the beer. Kegerators, however, are very expensive, cumbersome, require a power source, and not easily transportable for use at temporary events and functions.

The present invention, as further described below, overcomes the many disadvantages associated with conventional beer dispensing devices. The present invention provides for the first time a convenient, efficient, safe, compact, and portable draft beer dispensing apparatus that can be used to maintain the freshness of and chill beverages. The present invention uses gas to keep beer fresh and to permit proper storage of any unused beer for use at a later time. The present invention is portable, space and energy efficient, and is easy to transport, set up and break down. The present invention advantageously reduces or eliminates completely the unnecessary travel of beer through beer lines. The present invention provides cooling of the beer immediately before the beer is poured from a convenient height.

SUMMARY OF THE INVENTION

The present invention provides an easy to use, convenient, compact, energy efficient, labor efficient, cost-effective, fast, safe, neat, electricity-independent, portable beer dispensing device and system that uses $CO_2$ or other acceptable gas to maintain the freshness of beer, presents a convenient height and arrangement for dispensing chilled beer, and can be used in a variety of professional, casual, indoor and/or outdoor settings.

Instead of cooling the entire keg, the present invention cools smaller volumes of beer after it has come out of the keg, but before it is dispensed from the system. The present invention accomplishes delivery of cool beer by providing a separate housing component used to chill beer before it is dispensed. The housing component advantageously permits staggered cooling of the beer as it is drawn from the keg and prepared for consumption. Because the entire keg does not have to be cooled, the present invention provides a more energy efficient manner to prepare chilled beer for consumption and eliminates the need for use of a separate keg cooling container. Cooling of the beer may be accomplished by filling the housing component with one or more of ice, water, and any other suitable cooling agents, including for example, suitable refrigerants. In one embodiment, the housing component itself may be comprise multiple walls, for example a double-wall, that may be filled with insulation or any other suitable cooling agent. The housing component may, optionally, be pre-cooled and/or frozen prior to use in order to facilitate chilling of beer after it is drawn from the keg and before it is dispensed for consumption.

The present invention permits the dispensing of chilled beer without requiring use of a separate, often bulky, cooling container. All temperatures noted herein are in degrees Fahrenheit. The present invention can be optimally utilized with a keg of beer that has a starting temperature of between about 33 degrees and about 65 degrees, preferably between about 33 degrees and about 60 degrees, more preferably between about 33 degrees and about 55 degrees, and still more preferably between about 33 degrees and about 50 degrees, and most preferably between about 34 and 42 degrees. As used herein the term "starting temperature" refers to the keg temperature, including any beer contained therein, immediately prior to or upon attachment of the invention device and other system components to the keg.

The housing component may also include, attached to its external surface, a tap, multiple taps, or other suitable means to conveniently dispense beer directly from the housing component. The housing component may sit directly above, or be positioned within a reasonable proximity of, a beer keg or kegs.

The housing component may have singular, double, or multiple walls, include insulation, embedded cooling agents, one or more beer lines, one or more beer coils and/or other components, which can be used to facilitate beer storage, the chilling of beer, and/or as required to maintain beer freshness. Where more than one wall is present, the space between the walls is between about ⅛ inch and 2½ inches thick, preferably about ⅛ inch to about 1 inch thick, more preferably about ¼ inch to ¾ inch thick.

The interior members of the housing component may or may not be fixedly attached or detachable. Preferably, the housing component is designed to ensure optimal cooling of beer without unnecessarily wasting energy and/or cooling agents. The inner portion of the housing component, and/or interiors of any housing component walls, may be filled with a cooling agent so that beer flowing from the keg through the beer lines and coils is chilled. In addition to being more energy efficient, inclusion of beer lines, beer coils and/or such other components used to chill beer after it is drawn from the keg, within a singular housing component facilitates convenient and easy transport, handling, set up, break down, transfer, cleaning and implementation of the present invention. Additionally, inclusion of beer lines, beer coils and/or other components within the housing component of the present invention provides a safe, neat, attractive, and effective way to dispense beer without exposing beer lines, beer coils and/or other components to deleterious exterior air temperature or any other physical interferences found in the external environment. For example, inclusion of beer lines, beer coils and/or other components within a housing component may advantageously maintain the cool temperature of the beer contained in the lines up until the point immediately prior to dispensing the beer. Additionally, inclusion of beer lines, beer coils and/or other components within a housing component advantageously prevents tripping dangers that might otherwise accompany exposed beer lines attached to the outside of a keg.

The housing component may include all of, or some of, the beer line or lines. The beer line or beer lines used with the present invention may be of any suitable length. Preferably, however, the length of any beer line used to transport beer from a keg and into the housing component will be as short as possible. By keeping the length of the beer line or beer lines used to transport beer from the keg to the housing component as short as possible, the present invention overcomes many of the disadvantages associated with prior art beer dispensing devices because any beer in the beer line is less exposed to physical interference and temperature variations in the external environment. Advantageously, reducing the length of the beer lines results in a safer, more portable, more convenient, neater, and better functioning beer dispensing device and system.

Most preferably, depending on whether the present invention is located on top of, or in close proximity to, i.e., within one to four feet of, the keg or kegs, the housing component may include all of (100%), a majority of (greater than about 90%), or a substantial portion of (greater than about 50%), the beer line or beer lines used to transport beer from the keg or kegs. Accordingly, the beer line extending from the housing component and connecting to a keg may be completely, mostly, or partially contained within the housing component of the present invention. In one embodiment of the invention, the housing component includes a protruding structure which includes the beer line(s) and extends from the bottom surface of the housing component towards the keg coupler, and completely encloses the beer line(s) to prevent unwanted exposure of the beer line to the external environment.

The present invention may use beer lines of any length. It is noted, however, that shorter exposed beer lines maximize many advantages associated with the use of the present invention. Preferably, the exposed beer line is between about one inch and twelve feet, more preferably the exposed beer line is between about two inches and six feet, still more preferably, the exposed beer line is between about two inches and three feet. Optimally, the exposed beer line is between about two inches and one foot. However, even if the housing component is not located immediately on top of or otherwise adjacent to a keg or kegs, one or more exposed beer lines of any necessary length may extend between the keg or kegs and to the housing component of the present invention and other benefits of the present invention may be enjoyed.

A major advantage of the present invention is provided by the arrangement of its component parts. For example, in one embodiment, the housing component, which includes at least one beer line and beer coil, chills the beer, and has at least one beer faucet is situated above the keg and, thus, significantly reduces the amount of space required by conventional beer dispensing devices and systems that require keg cooling. Additional advantages are provided by the consolidation of the beer line(s) and coil(s) within the housing component as this arrangement of parts reduces extra lines typically hanging about the keg and conventional beer dispensing devices.

The housing component of the present invention is filled with cooling agents to chill beer after it leaves the keg and before it is dispensed. The housing component may contain cooling agents, such as ice and water, or any other suitable cooling agent, in various ratios. For example, the housing component may contain ice and water in ratios of about 80:20, 70:30, 60:40, 50:50, 40:60, 30:70, 20:80, 10:90, 5:95, etc. However, an optimal ratio of ice to water would be between about 70:30 ice to water and 30:70 ice to water, more preferable is a ratio of ice to water between about 60:40 ice to water and 40:60 ice to water, and most preferable is a ratio of about 50:50 ice to water. Of course it is understood that the precise ratio of ice to water is subject to change as ice melts. A desirable ratio of ice to water, or other cooling agent, can be maintained in the housing component, for example, by opening a drain plug in the base of the housing component to remove water. For example, water and/or ice can be added to the housing component via the top opening of the housing component during the use of the present invention to adjust the ratios of cooling agents used and/or to replace cooling agent(s) that have been removed. The drain plug may be of any type, including a threaded screw, a pull plug, and/or any similar type of instrument.

Generally, most domestic and mainstream lager style beers can be optimally used with the present invention when the keg has a starting temperature of between about 33 and about 55 degrees. Meanwhile, craft style micro-brew beers typically can be optimally used with the present invention when the keg has a starting temperature of between about 34 and about 42 degrees. When a keg of beer having a suitable starting temperature is connected to the present invention, and the use of cooling agents in the housing component is monitored, the present invention provides a steady flow of suitably chilled, fresh, foam free beer as it is dispensed, even if the keg itself warms while the present invention is being used.

In a preferred embodiment, the present invention is rested directly on top of a beer keg and optimally provides a convenient pouring height for chilled beer via beer faucet placed near the top of the housing component.

Optionally, however, the present invention may be placed on top of a table or other presentation, dispensing and/or serving surface. The beer line that runs from the housing component may be extended and run to the keg coupler on the keg that may be placed under the table or elsewhere. This will allow the use of a table or other surface for dispensing beer alongside promotional items, etc. Use of the present invention results in a safer and visibly neat beer dispensing area. A person serving beer using the present invention may also, beneficially, face others while dispensing beer to create a more social and less awkward exchange.

The beer faucet is preferably located near the top of the housing component to facilitate pouring beer from a more convenient height. For example, a beer faucet may be placed within about 8 inches of the top edge of the housing component. Preferably, the beer faucet is located within about one inch to six inches of the top edge of the housing component. More preferably, the beer faucet is located within about two inches to four inches of the top edge of the housing component. Most preferably, the beer faucet is located within about three inches of the top edge of the housing component.

The present invention also involves using one or more $CO_2$ gas tanks, or other suitable gas tanks, to propel the beer from the keg so that the beer stays fresh for a longer period of time, as compared to devices which use atmospheric air which causes beer to go flat. The gas tank or tanks may be equipped with a regulator to adjust gas levels based on such factors as temperature, volume, etc., to ensure that proper gas levels are maintained within the beer. Nitrogen based beers may also be used with the present invention. Substituting $CO_2$ gas tanks for nitrogen gas tanks or any tank containing any blend of gases suitable for the pouring of beer allows for a variety of beer styles to be poured. $CO_2$ is specifically addressed in detail below, but the present invention contemplates that nitrogen and any other gas or blend of gases suitable for the dispensing of beer may be used.

A $CO_2$ tank or tanks can be mounted on the present invention, connected the present invention by a holding component, or located nearby the keg. For example, a $CO_2$ tank or tanks can be mounted on the rear, bottom portion of the housing component and connected to the keg coupler to propel the beer through the beer line coils and out through the faucet. The $CO_2$ tank or tanks can range in size from approximately 4 inches wide by 4 feet tall to. Light and compact gas tanks are preferred and may range in weight from about 2 to about 10 pounds, preferably about 2 to about 6 pounds, and most preferably about 2.5 pounds to about 5 pounds.

The holding component may be, for example, a strap or sling, or other similar component, for use as part of the invention. In one embodiment, a strap or sling can be used to attach the $CO_2$ tank or tanks to a convenient and safe location near the beer keg. For example, a $CO_2$ tank or tanks may be placed inside a pocket or pockets at either end of a strap or sling that runs through, over, or around the handles of the keg rim and hangs on either side of the keg. The strap or sling may be arranged to accommodate placement over and/or around the keg coupler. This system configuration allows for the $CO_2$ tank or tanks to rest in one or more side pockets of a strap or sling. Optionally, a drain pail may be placed in at least one of the side pockets of the strap or sling, or other similar holding component. The holding component may wholly cover or partially cover the keg and/or the keg base. The holding component may be comprised of a variety of different materials, including but not limited to metals, plastics, and synthetic or organic materials, including fabrics, and may be of any color, design, etc. The holding component may be made to order and/or customized to a particular event and may, optionally, include logos, teams, slogans, etc.

In an alternative embodiment, the $CO_2$ tank or tanks may be rested on the ground beside, or within reasonable proximity of, the keg and the present invention.

The housing component of the present invention may take any form or shape, such as a columnar or cylindrical tube, box, sphere, novelty designs, and the like. A preferred embodiment of the housing component is a cylindrical tube.

The exterior materials of the present invention such as the housing component, base plate, spacer plate, support legs, balancing legs, etc., can be made from various materials, including but not limited to, all grades of stainless steel, chrome plated metals, all grades of steel and metals, and/or all grades of hard and durable plastics.

The beer coil lines can be made from stainless steel or any other non corrosive material that remains safe to have in contact with liquid and maintains fluids at a safe consumable standard for human consumption. Connections made between coils and rubber hosing that carry beer may be food grade rubber or plastic. Beer dispensing faucets for use with the present invention will typically be stainless steel and will be separately incorporated into the present invention. Keg couplers incorporated with the present invention may comprise any of a variety of metals or other suitable materials. Holes or opening that are in the housing component can have lines running through them that will be sealed water tight with any of a variety of acceptable plastic, rubber, and/or other similar options.

One embodiment of the present invention is directed to a beer dispensing device made available for heavier duty more frequent use and requires a sturdier model. Such a heavy duty version of the present invention may be made of stronger grade steel options, is built to last, and can handle any abuse that a careless user may inflict. All exterior parts may be made of heavy duty steel or metal options and the interior coils will be made of stainless steel.

Another embodiment of the present invention may be produced for the more casual user. This model may have all the exterior parts made out of a variety of heavy duty hard plastics or a lower grade exterior steel/metal, and may be produced from a mold. The connections and inner workings of the present invention may be stainless steel.

The present invention may be finished using any number of processes, including, but not limited to, paint, chrome plating, ionization, polishing, etc. The finish surface of the present invention may be customized so as to be visually pleasing and/or adapted for a particular purpose or event.

The present invention may further include a skirt that wraps wholly or partially around one or more of the keg and keg base. The skirt may be available in a variety of materials, including but not limited to fabrics, which may be of any color and design. The skirt may be customized to a particular event and may include logos, teams, slogans, etc.

As an example of one type of housing component, the width of a substantially cylindrical tubular housing component may range from about 4 inches wide to about 16 inches wide, preferably from about 6 inches to about 12 inches wide, and more desirably from about 8 inches to about 10 inches wide. The height of the cylindrical tubular housing component may be from about 4 inches to about 48 inches tall, preferably from about 12 inches to about 36 inches tall, and more desirably from about 18 inches to about 24 inches tall.

The housing component, excluding the weight of any cooling agent or agents added immediately prior to use, may weigh anywhere from between about 5 pounds and about 40 pounds, preferably between about 6 pounds and about 30 pounds, more preferably between about 6 pounds and about 20 pounds, and still more preferably from about 8 pounds and about 15 pounds.

The present invention may weigh anywhere from about 5 pounds to about 75 pounds, preferably weighs between about 5 pounds and 50 pounds, more preferably weighs between about 6 pounds and 45 pounds, still more preferably weighs between about 8 pounds and 40 pounds, and most preferably weights between about 8 pounds and 20 pounds.

The housing component may be attached to the keg via a base plate and, optionally, a spacer plate. The base plate and the spacer plate can, optionally, be presented together as a single component instead of two separate components. The housing component may be attached to the base plate and/or the spacer plate using any various types of connection devices, including but not limited to, clamps, screws, swivel clamps, hooks, bands, etc. The base plate and/or the spacer plate is attached to the keg via connection devices that attach to the rim of the keg and/or the spacer plate. Connection devices may be located at regular intervals upon or around the edge of the base plate. In one embodiment, both the a base plate and the spacer plate of the present invention may also include one or more non-slip surface materials to allow the present invention to rest clamp free if desired on top of the keg or to rest on top of table or other surface.

The base plate of the present invention can be anywhere from about 8 inches to about 32 inches wide, preferably from about 16 inches to about 26 inches wide and more desirably from about 16 inches to about 20 inches wide.

The spacer plate provides space for running the beer line or beer lines, for running at least one gas line to the keg coupler and any drain pail line to the housing component of the present invention. The spacer plate thus consolidates the external lines associated with the present invention together into a more confined, safe, and easily managed space. Additionally, the spacer plate can provide an additional advantage of elevating the housing component of the present invention to a higher height to further facilitate convenient beer pouring.

The present invention may be further stabilized by using any of a number of optional keg stabilizing components. For example, a keg "boot," in which a keg is placed, may be used. A keg boot may be made in any size to accommodate the corresponding keg size. This keg boot may have four corners or be of an extended round shape with a round place holder for the keg in the center, the four corners or extended round shape extends out from the keg for optimal stability. The keg boot will extend out from the keg at least about 3 inches, more preferred is a keg boot that will extend out from the keg at least about 6 inches, still more preferred is a keg boot that will extend out from the keg at least about 9 inches, most preferred is a keg boot that will extend out from keg at least about 12 inches or more. These boots can be made of various materials, including plastic, metal and fiberglass etc.

In one embodiment, the keg may be stabilized by attaching the keg to another object, such as a wall, table, tree, rock, etc., using any appropriate means, including but not limited to, a rope, strap, bungee cord, hook, or similar item.

Another optional stabilizing component for use with the present invention includes adjustable and/or detachable balance legs that extend down from the housing component, keg, base plate and/or the spacer plate edge to directly make contact with the ground. The legs may be adjustable in height so that they can accommodate any keg height and/or to make contact with varying surface levels and/or ground conditions. In one embodiment, the balance legs are telescoping. The balance legs can attach at any point around the base plate and/or the spacer plate of the present invention.

The support legs and balance legs can be made from various materials, including but not limited to, strong steel or other metal options as well as any high quality plastic materials. The support legs and balance legs may vary from basic to complex. The housing component, base plate, spacer plate, keg(s), all working parts and any tanks, etc., may be completely or partially concealed by a skirt, strap and/or sling, or other holding component. Alternatively, the support legs and balance legs may be comprise an ornamental design, and may resemble, for example, more fanciful figures of art, animals or insects, fictional creatures, new creative designs, buildings, national landmarks, etc.

Transferring the present invention from one keg to another is easy and straightforward. To transfer the single faucet version of the present invention to another keg of beer while it is resting on top of an empty keg, the keg may be untapped, the present invention lifted off of the empty keg and set on top of a new and full keg of beer. Once the present invention is rested securely on top of the new keg, the coupler is engaged to the new keg and beer can be served. To transfer the present invention when it is resting on top of a table or other surface and the keg is under the table or along side of the present invention, simply un tap the empty keg and then tap a full keg then begin to serve beer again.

To transfer the dual faucet version of the present invention when it is resting directly on top of a keg. When the keg under the present invention is empty, untap the empty keg, lift the present invention off the empty keg and place it on top of a full keg and engage the coupler to serve beer. When the second keg is empty, un tap the empty keg and tap a full keg and serve beer. To transfer the dual faucet version of the present invention when it is resting on top of a table or other surface untap the empty keg and tap a full keg then serve beer.

Cleaning the present invention requires little effort. To clean the present invention after use, open a drain on the bottom of the housing component and let all of the water drain out, flush out the housing component with additional water if needed to melt and drain any existing ice. Alternatively, the housing component may be inverted to allow any cooling agent contained therein to flow out. To clean the beer lines run cleaning solution through them and flush them with water until all cleaning solution has been rinsed away. In one embodiment, this may be done by tapping a cleaning keg that is filled with cleaning solution, then opening the faucet and letting it run through the lines, then filling the cleaning keg with water and running that through to clean the lines. In another embodiment, the faucet may be removed and connected to a hand pump cleaning device filled with solution. The hand pump can then be used to pump solution through the lines from the faucet to the opened coupler.

Due to its compact size and low weight, the present invention may be readily transported in many different ways. While the present invention may optionally include any number of carrying components to facilitate its transport. The present invention may be carried as is or, for example, may also be carried via a fixed handle that is attached to the housing component, base plate, spacer plate or other part, and carried like a suitcase. The handle may be made of various materials, including but not limited to, hard steel, leather strap, synthetic or natural fabric, and/or other strong material, etc. It may also, for example, be transported by a customized back pack type carrier designed to carry the present invention. The back pack may be of any type, including a duffle style back pack that straps onto the present invention, has at least one shoulder strap and, optionally, neck and/or back pads, so that it can be worn and carried long distances with little discomfort or effort. Optionally, the present invention may have snap on supports or straps that hold all the of the peripheral or optional device components such as the gas tank or tanks, drain pail, coupler, any extra cups or equipment, etc, and that are used to connect the various components to the carrying component so that all parts can be carried in the back pack. Alternatively, another option may be putting the present invention into a hard fiberglass or other sturdy material style box that has wheels and a retractable or affixed handle and lid so that all of the components of the present invention can be kept and stored within this box and transported much like a suitcase.

In one embodiment, electrical elements may be optionally incorporated into the present invention itself or its carrier components to allow for solar power of music devices, portable communication devices, lights, and sound elements which may be added to the present invention.

The present invention is convenient to set up and break down. To begin set up, the drain valve of the housing component of the present invention is closed and the housing component is filled with water. Various amounts of water may be used, and, optimally, two liters are used, to fill the housing component. In one embodiment of the present invention, the housing unit and, optionally the $CO_2$ tank or tanks and a strap or sling, is adapted to be worn on the back of a person as part of a back pack type carrying component.

To transport and set up the present invention, a keg of beer may be placed onto a dolly, hand truck or similar device, with a bag of ice on top. The present invention may be worn as part of a carrying device. The keg and the present invention may be walked to the set up location together in one trip. Upon arrival at the set up location, the keg can be rested on the ground or table, etc., and the present invention, including any or all of its component parts, may be removed from the carrying component. A strap or sling component may be used to hold a $CO_2$ tank or tanks or a drain pail, or cups, etc., close to the keg and, optionally, up off of the ground or keg resting surface.

In one exemplary embodiment, setting up the present invention for use may involve the following sequence of steps. First, once the keg and the present invention are delivered to the set up location, a 2.5 pound $CO_2$ tank and drain pail is removed from the carrying component of the present invention and a neoprene strap or sling is used to hang them from the keg adjacent to and touching the keg. The $CO_2$ line traveling from the keg coupler to the $CO_2$ tank regulator is connected and the open end of the water drain line is connected through the drain pail lid. The $CO_2$ tank is opened, engaging the keg coupler and keg. The faucet can then be opened to allow beer to flow through the stainless steel coils within the housing component of the present invention. After about 30 ounces of beer flow through the faucet the housing component is filled with ice and water. The housing component will have an approximate 50:50 ratio of ice and water. After about five minutes chilled carbonated beer will be ready to serve.

BRIEF DESCRIPTION OF THE DRAWING(S)

DETAILED DESCRIPTION OF THE INVENTION

The figures and detailed descriptions of the figures do not reflect all embodiments of the present inventive device and system, but are provided for example and explanatory purposes, as described below. For example, certain embodiments of the present inventive device and system include one or more of balance legs, a structure protruding from the housing component and extending towards the keg couple that encloses at least one beer line, a combined single piece base plate and spacer plate, a carrying component, etc., and may involve various configurations of the set up as described herein, even if not specifically shown in the figures.

Figure 1:
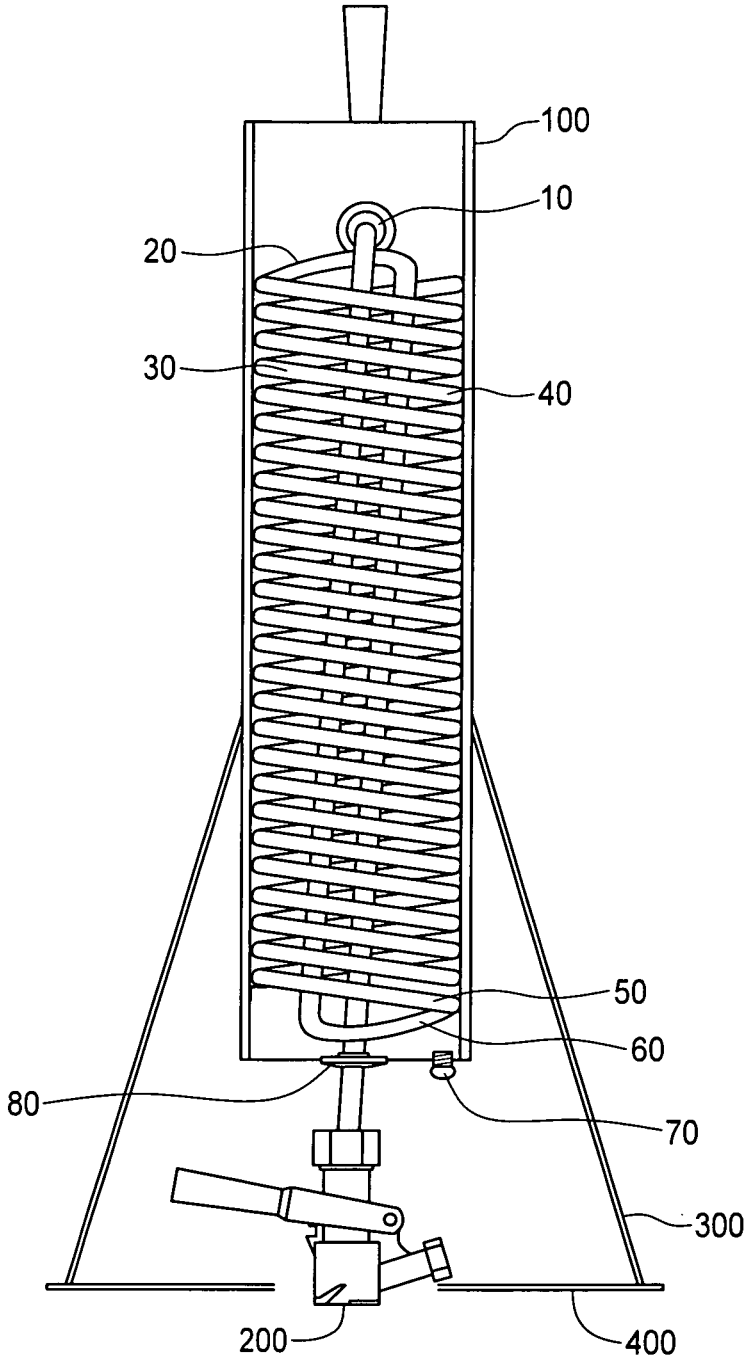
FIG. 1 is a back internal view of single faucet embodiment of the present invention.

FIG. 1 shows a back internal view of single faucet embodiment of the present invention. Component (10) is the back of the beer shank and washer that is part of the faucet. The plastic beer line connects to this shank so beer can flow from the coils and out through the faucet. Component (20) refers to the wide portion of a plastic beer line used to connect the tap and the narrower reducer connector (not shown in detail). Component (30) refers to the upper reducer connector (not shown in detail) which connects the wide stainless steel beer line to the narrower stainless steel beer line. The stainless steel beer line coil on this end may have a permanently attached stainless steel nipple (not shown in detail) that attaches to the wide beer plastic line. Component (40) refers to the stainless steel beer line coils. The stainless steel beer line coil is preferably about 120 feet in total length. The first 80 feet of the stainless steel beer line coil attaches to the vertical wide plastic beer line (3/8 inch) and the last 40 feet of the stainless steel beer line coil is narrower (3/16 inch). The stainless steel coil is coiled within the housing component (100) of the present invention and, as shown in this embodiment, is flush with the inside of the housing component (100). Component (50) refers to the lower connector used to permanently attach the narrower stainless steel beer line (3/16 inch) to a plastic beer line (3/8 inch) via a stainless steel nipple (3/16 inch). Component (60) refers to a narrow portion of the plastic beer line. One end of component (60) attaches to the 3/16 inch inline beer line connector (not shown in detail) and the other end attaches to the back of the 1 inch beer shank. Component (70) refers to the drain plug. The drain plug (70) may be threaded to screw into a hole in the base of the housing component (100) of the present invention. Drain plug (70) allows for drainage of any excess water, or other cooling agent, that accumulates inside the housing component (100). Component (80) refers to a rubber o-ring seal. The rubber o-ring seal is inserted into an approximately 1 inch hole in the center and base of the housing component (100) of the present invention. Through this hole and rubber o-ring seal runs the ⅜ inch plastic beer line allowing for movement of the beer line while keeping a water tight seal. Component (200) refers to a keg coupler or a tri-tap coupler. Existing products that vary in design based on the style of keg to be tapped may be used. Component (200) allows beer to be released from the beer keg and $CO_2$ to be used as a means for propelling the beer from the keg through the beer lines and out of the faucet. Component (300) refers to a support leg used to hold the housing component (100) of the present invention upright and in place over the base plate. The support legs (300) are placed in a tri-pod fashion, equally spaced from one another with one leg being directly mounted under the beer faucet, drip pan, and drip pan mount. Component (400) refers to a base plate. The base plate (400) may be directly on top of the keg of beer being used(not shown in detail). The support legs (300) are affixed to the edge of the plate (½ inch in from the edge) directly in line vertically from where they are mounted to the housing component (100) of the present invention. This base plate is responsible for supporting the weight of the housing component (100) of the present invention.

Figure 2:
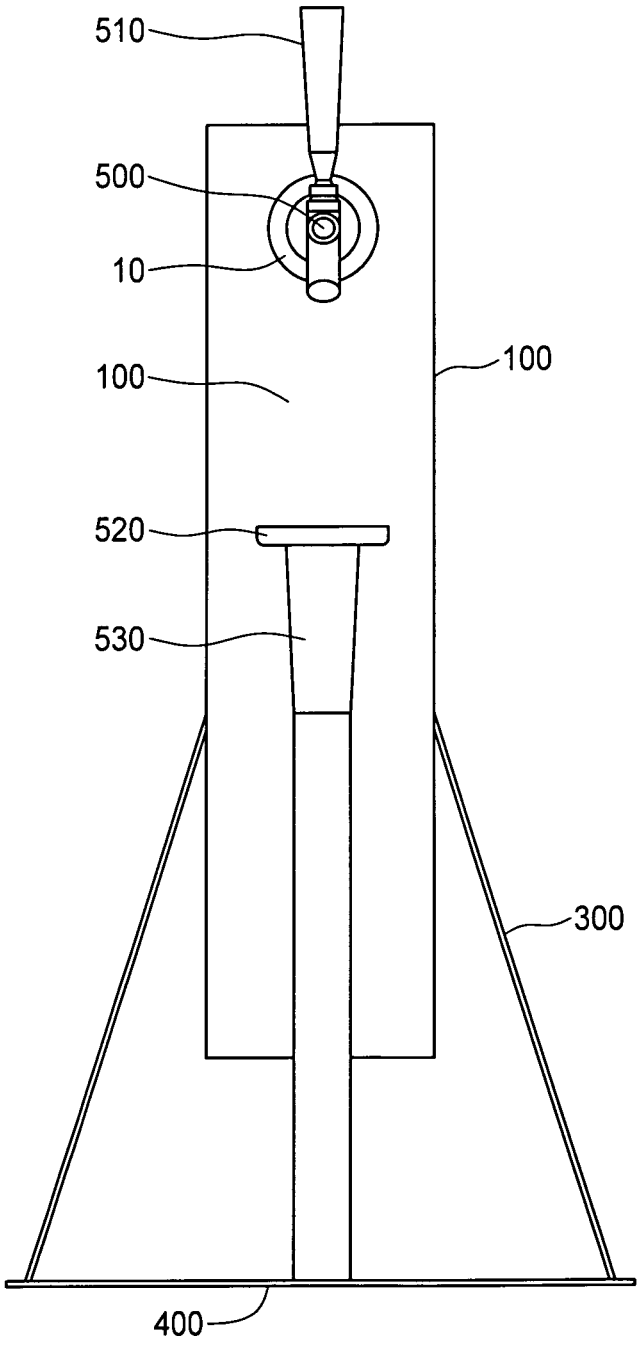
FIG. 2 is a front view of single faucet embodiment of the present invention.

FIG. 2 shows a front view of single faucet embodiment of the present invention. Component (510) refers to a beer tap handle. Existing products that vary in design based on the style of beer dispensed may be used. Interchangeable beer tap handles (510) may attach to the beer faucet. Pulling this handle forward (away from the housing component (100)) will allow the flow of beer from the faucet and into your glass. Component (500) refers to a beer faucet which is used as a start/stop device to control whether the beer is flowing out or not. Component (10) refers to a faucet washer. The washer (10) is placed around the shank and behind the faucet (500) to allow for a secure attachment of the shank and faucet to the housing component. Component (100) refers to the housing component (100) of the present invention. The housing component (100) includes the beer lines and stainless steel coils. The housing component (100) itself is made from double walled aluminum, stainless steel, or other hard rust proof material. The space between the walls is ⅛ inch think and is filled with insulating material so that the interior of the housing component can be filled with ice and water and kept cold for a prolonged period of time. Component (520) refers to a drip pan. The drip pan (520) is mounted onto the keg cannon cylindrical vertical housing component to catch any dripping beer from the faucet. Component (530) refers to a drip pan mount. The drip pan mount (540) is simply a means of securing the drip pan (520) to the housing component (100) of the present invention. Component (400) refers to a base plate which may rest directly on top of the keg of beer being used (not shown in detail). The base plate may, optionally, have a non-slip surface facing the top of the keg. The support legs (300) are connected to the edge of the base plate (400) directly in line vertically from where they are mounted to the housing component (100). The base plate (400) is responsible for supporting the weight of the housing component (100) of the present invention.

Figure 3:
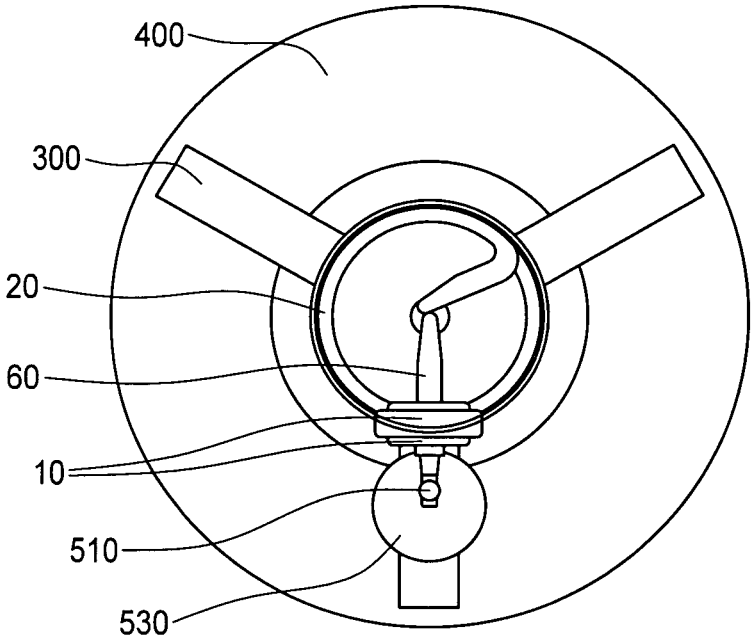
FIG. 3 is a top internal view of single faucet embodiment of the present invention.
Figure 4:
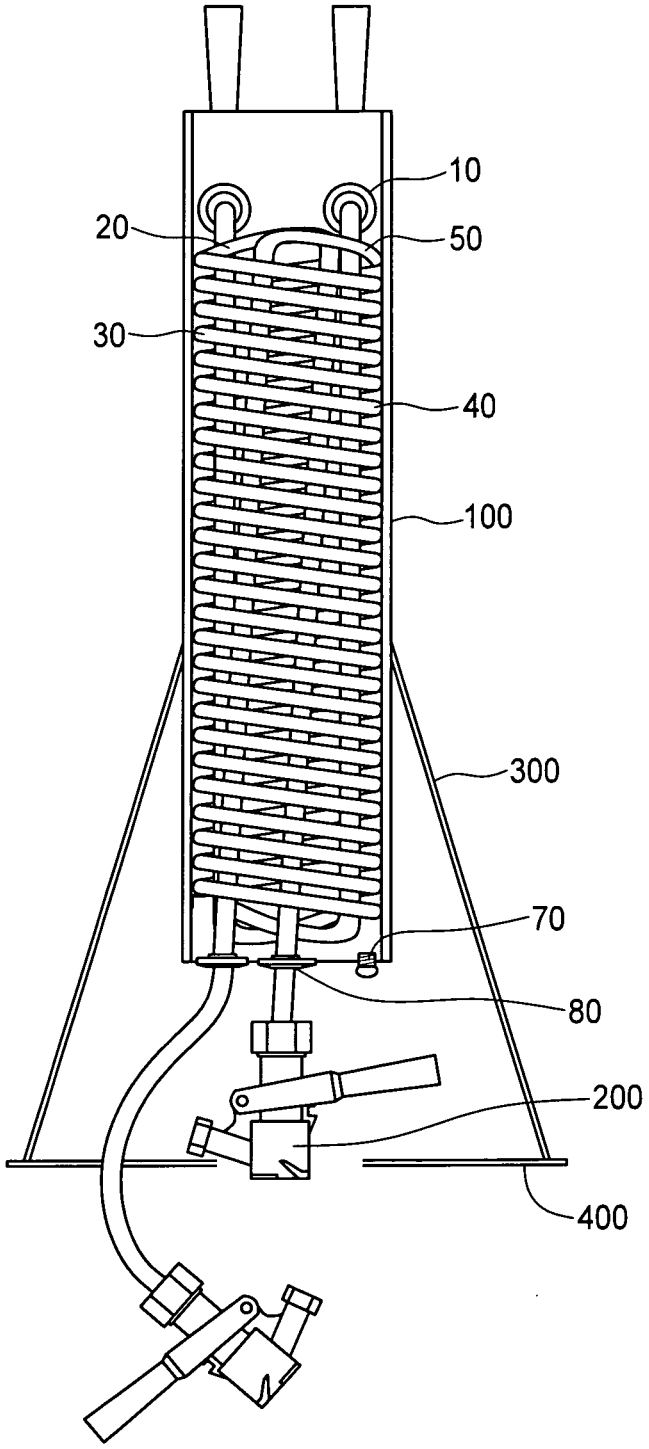
FIG. 4 is a back internal view of double faucet embodiment of the present invention.
Figure 5:
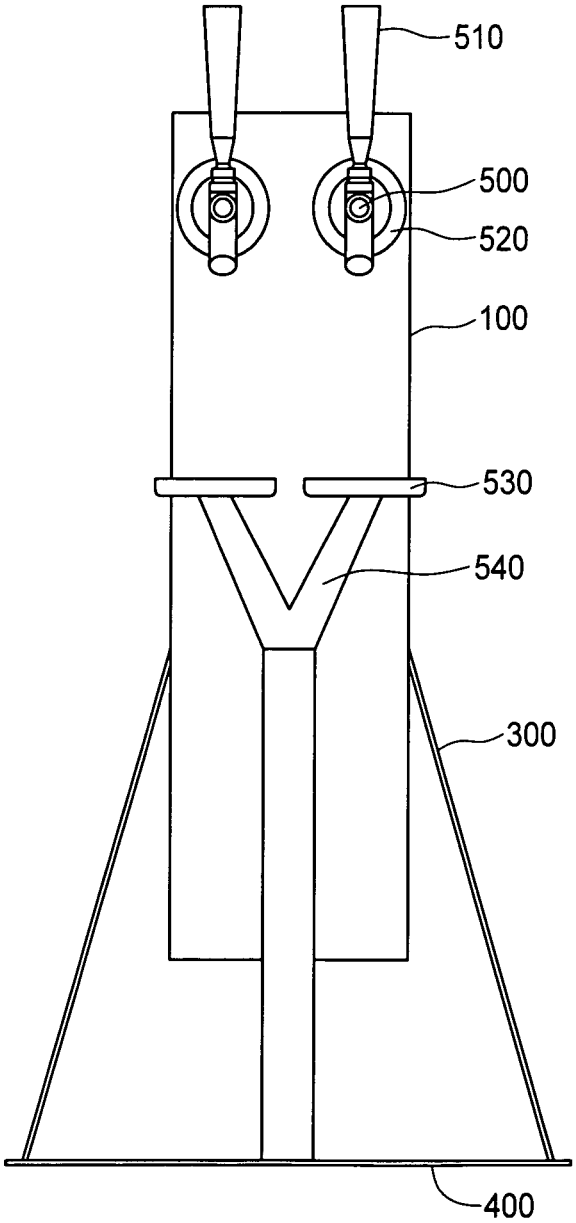
FIG. 5 is a front view of double faucet embodiment of the present invention.
Figure 6:
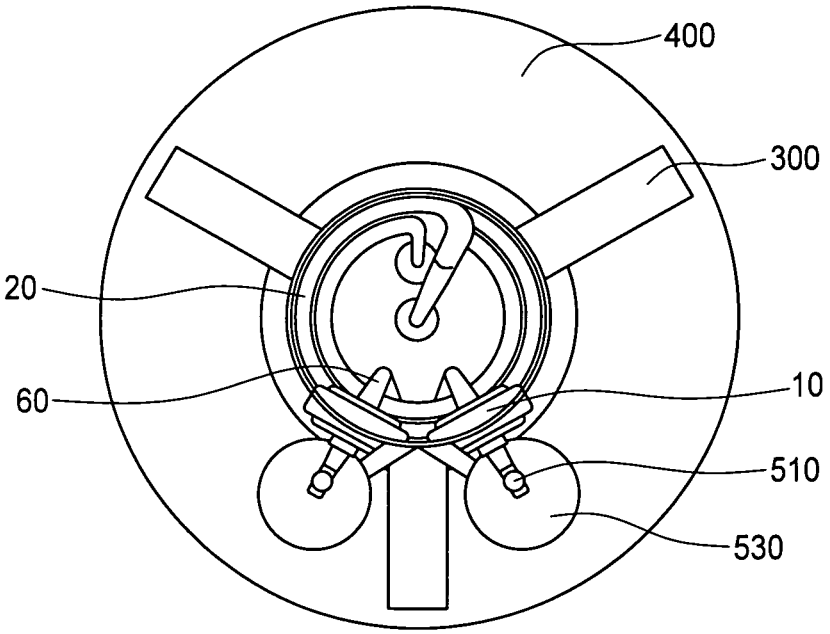
FIG. 6 is a top internal view of double faucet embodiment of the present invention.

FIG. 3 is a top internal view of single faucet embodiment of the present invention. The base plate (400) rests directly on top of the keg of beer being used (not shown in detail). The support legs (300) are connected to the edge of the base plate (400) directly in line vertically from where they are mounted to the housing component (100). The base plate (400) is responsible for supporting the weight of the housing component (100) of the present invention. Component (300) refers to the support legs. The support legs (300) are mounted equally distanced from each other with one leg being mounted directly under the drip pan. The lower ends of the support legs (300) are mounted to the edge of the base plate (400) and are equally spaced and vertically aligned. Component (20) refers to the wide portion of a plastic beer line. This portion of the plastic beer line comes directly from the keg coupler (200) and connects to the 3⁄18 inch to 3⁄16 inch reducer connector (30). Component (60) refers to the narrow portion of the plastic beer line. One end of component (60) attaches to the 3⁄16 inch inline beer line connector and the other end attaches to the back of the 1 inch beer shank. Component (10) refers to the beer shank and washers. This figure provides a top view of the beer shank and washer that are part of the faucet. Component (510) refers to a beer tap handle (510). Component (520) refers to a drip pan. The drip pan is mounted onto the housing device (100) to catch any dripping beer from the faucet (500).

Thus, FIG. 2 illustrates a front, exterior view of an exemplary beer dispensing device with a beer tap handle (510), a beer faucet (500), a faucet washer (10), a housing component shaped as a cylindrical vertical housing component (100), a drip pan (520), a drip pan mount (530), support legs (300) and a base plate (400). The exemplary beer dispensing device is comprised of a cylindrical, vertical housing component (100) that houses a beer line (20, 60) (shown in FIG. 1) connected to the beer line coils (40) (shown in FIG. 1) in the inner portion of the housing component (100). The outer portion of the housing component (100) is vertically and cylindrically shaped and is insulated within the entire outer length of the housing component to keep the beer cold while holding ice and water within the hollow inner portion of the housing component (100). The beer dispensing device stands erect above a keg with its own weight supported on top of the keg with the support legs (300) and base plate (400) supporting and holding the outer housing component (100) with the inner parts as shown in FIG. 1. The beer dispensing device is approximately 31 inches in total height, 16 inches wide at the base plate section, and 6 inches wide in diameter throughout the height of the housing component (100). The housing component (100) is approximately 25 inches high and 6 inches wide in diameter. These measurements are approximate dimensions and exemplary and are not meant to be limiting in nature.

The outer housing component (100) is the housing component of the beer dispensing device with its interior parts. The housing component (100) houses the beer shank and washer (10), beer lines (20, 60) and connectors (30, 50). The housing component (100) is preferably made from a double-walled aluminum or stainless steel metal or a high quality, hard and durable plastic. This material is not meant to be limiting and other similar materials can be used to make the housing component (100). The space between the two walls of the housing component (100) is approximately ¼ inches thick and is filled with any insulating material. Insulation within the housing component (100) can be filled with a layer of insulation, including but not limited to, foam padding, expanding foam, other kinds of closed or open foams, fiberglass, latex, plastic, rubber, cooling agents, or all grades and/or varieties of each material can be used.

The beer tap handle (510) varies in style based on the beer being used, and any beer tap handle (510) can be implemented depending on the type of beer being served or dispensed. Therefore, the interchangeable beer tap handle (510) attaches to the beer faucet (500) on the upper, front portion of the housing component (100) for easy access when dispensing beer. The faucet (500) is installed in the upper, front portion of the housing component. By pulling the beer tap handle (510) towards the ground in either direction so that the handle (510) is perpendicular to the device, the faucet (500) is opened to allow the beer to flow from the keg through the beer lines out through the faucet (500). The faucet (500) and the handle (510) work together to provide a start and stop mechanism to control the beer flow.

The shank (10) portion of the beer faucet (500) protrudes into the inner portion of the housing component (100) so that the beer line (20) can connect to the shank (10). A faucet washer (10) is shaped as a hollow ring for inserting the shank (10) portion of the faucet (500) through the hole while the outer, circular edges snugly fits around and over the opening of the housing component (100) in the upper portion where the faucet (500) is positioned. The faucet washer (10) is securely positioned around the shank (10) portion of the faucet and the opening of the housing component through which the shank (10) sits to allow for a secure attachment of the shank (10) and faucet (500) to the top, front portion of the housing component (100). The shank (10) and beer faucet (500) are installed about 3 inches down from the top of the housing component (100).

The beer dispensing device further has a drip pan (520) that is mounted in the front at a mid-section of the housing component (100) to catch any dripping beer from the faucet (500). The drip pan (520) has edges that are curved upwardly to hold any dripping beer. The drip pan (520) may be permanently affixed to the housing component (100) or detachable for easily removing any accumulated beer. The side of the drip pan (520) touching the housing component (100) is inwardly curved so that the drip pan (520) fits over the cylindrical part of the housing component. The drip pan (520) spans approximately two-thirds of the front portion of the housing component (100). The drip pan mount (530) beneath the drip pan (520) is simply a means of securing the drip pan (520) to the front section of the housing component (100).

The beer dispensing device is supported by at least one but preferably three support legs (300). The support legs (300) are mounted equidistant from each other with one support leg (300) being mounted directly under the drip pan (520) to support the drip pan mount (530) and drip pan (520). The lower ends of the support legs (300) are mounted approximately ½ inches from the edge of the base plate (400) equally spaced and slanted inwardly towards the housing component (100). Each support leg (300) is attached to the housing component (100) at approximately 15½ inches above the base plate (400). The opposite sides of the legs are attached to the base plate (400) at approximately ½ inches from the edge. Each support leg (300) is approximately 18 inches in length. These measurements are exemplary and are not meant to be limiting. The support legs (300) are used to hold the housing component (100) in a stable upright position over the base plate (400). Even though the support legs (300) are positioned in a tri-pod fashion, equally spaced from one another with one leg being directly mounted under the beer faucet (500), drip pan (520), and drip pan mount (530), the support legs (300) can be constructed as one continuous piece such as a cone with a opening only at the front portion of the housing component (100). These support legs (300) can be modified in any design as long as they can support the weight of the housing component (100) when the beer dispensing device is in use.

The base plate (400) is shaped as a flat donut that has a center hole in similar size as the diameter of the keg coupler (200) to sit over the top of a keg. This base plate (400) rests directly and flatly on top of the keg of beer being used. The base plate (400) is approximately ⅛ inch thick. This hole in the center of the base plate (400) allows for the keg coupler (200) to be attached to the keg.

The support legs (300) are permanently affixed to the edge of the plate or approximately ½ inch in from the edge and inwardly slant towards the housing component (100) at an angle of at least 50 degrees or more away from the base plate (400) to be permanently attached between lower to mid-section of the housing component (100). The housing component (100) is positioned and centered approximately 6 inches above the base plate (400). This base plate (400) and the support legs (300) essentially support the weight of the housing component (100) containing the inner parts as well as ice and beer during use.

FIG. 1 is a back, interior view of an exemplary beer dispensing device. The interior parts of the beer dispensing device are comprised of a beer line (20, 60), beer line coils (40), lower and upper connectors (30, 50), beer shank and washer (10). Externally, the beer dispensing device requires a keg coupler (200) or a tri-tap coupler that connects a keg to the beer lines (20, 60) within the housing component (100). The keg coupler (200) is interchangeable to accommodate any type of a keg. The keg coupler (200) (which some time is also referred to as a sankey) is available in various designs. The keg coupler (200) basically allows for beer to be released from the beer keg and also contains an outlet to plug a $CO_2$ tank to be used as a means for propelling the beer from the keg, through the beer lines and connectors (20, 30, 40, 50, 60, 10) to the faucet (500). A lightweight $CO_2$ tank (not shown in these Figures) can be mounted on or placed near the rear part of the housing component (100) when it is connected to the keg coupler (200). A separate and detached $CO_2$ tank may also be used as well that rests on the ground beside the keg.

The inner, hollow portion of the housing component (100) can be filled with ice and kept cold for a prolonged period of time since the insulation of the housing component (100) keeps the beer within the housing component (100) cold. More specifically, the beer line (20, 60) and beer line coils (40) come in contact with ice to continuously chill the beer flowing through the beer line (20, 60) and beer line coils (40) from the keg to the faucet (500). Due to the chilling of the beer lines (20, 60) and beer line coils (40) within the housing component, there is no need to ice down or cool down the keg separately. The beer lines (20, 60) and beer line coils (40) containing beer are constantly bathed in ice water and chilled before and during dispensing.

The bottom surface of the housing component (100) is sealed with a first removable cap. The bottom surface also has a channel in the center with a rubber grommet or o-ring (80) allowing a wide beer line (20) to run through the channel while keeping the bottom surface of the housing component (100) water tight and allowing easy adjustment of the vertical movement of the beer lines (20). The channel is approximately 1 inch for accommodating the wide beer line (20). This o-ring seal (80) is inserted into the channel in the center on the bottom surface of the housing component. The wide beer line (20) runs through this channel with the rubber o-ring seal (80) to allow vertical and flexible movement of the wide beer line (20) while keeping a water tight seal to prevent water from dripping out of the housing component (100). The housing component (100) may also have a protruding structure (not shown) within which the beer line (20) sits and is insulated. This protruding structure may be rigidly affixed to the bottom surface of the housing component (100) and extends towards the keg coupler. The distal end of the protruding structure may have a connecting means for attaching the keg coupler (200). Therefore, the beer line (20) may be completely insulated within the housing component (100) and the protruding structure to avoid coming in contact with the outer, warm environment.

The bottom side of the housing component (100) also has a drain plug (70) position at the right or left direction away from the center so that any melted ice can drain easily from the housing component at the bottom of the housing component (100). The drain plug (70) is threaded and screws into a hole of approximately ½ inch at the bottom side of the housing component (100) into a ½ inch hole. By simply unthreading or unscrewing the drain plug, any excess water accumulated inside the housing component is readily drainable and more ice can be inserted from the top side of the housing component (100). The top side of the housing component can be open but preferably closed with a removable cap to keep the temperature cold within the housing component.

A wide portion of the beer line (20) at the lower end of the housing component (100), with a diameter size of approximately ⅜ inch, connects directly from a keg coupler (200) and comes straight up to the upper end of the housing component (100) to be connected to an upper connector (30). The upper connector (30) is a reducer connector that connects the wide ⅜ inch beer line (20) to the narrower 3⁄16 inch beer line coil (40). The beer line coil (40) at this upper end has a permanently attached ⅜ inch nipple to tightly attach to the wide beer line (20). The nipple can be made from stainless steel or other similar materials to connect the beer line coil (40) to the wide beer line (20).

The beer line coil (40) is approximately 3⁄16 inch in diameter and 60 to 80 feet in total length. The beer line coil (40) is flush against the inner wall of the housing component (100) and tightly coils all the way down to the lower portion of the housing component (100) to be connected to a second, lower connector (30). The second, lower connector (30) is approximately 3⁄16 inch in diameter. One end of the lower connector (30) is permanently attached to the beer line coil (40), and the other end of the lower connector (30) is attached to the narrow beer line (60) via a 3⁄16 inch nipple preferably made of stainless steel or other similar materials. The narrow beer line (60) is approximately 3⁄16 inch in diameter that attaches from the lower connector (30) and continues straight up to the upper portion of the housing component (40) to the shank (10) portion of the faucet (500). The beer lines (20, 60) and beer line coil (40) are hollow so that beer can easily reside and flow through the lines. Therefore, the beer flows from the keg through the keg coupler (200) into the wide beer line (20), traveling in the wide beer line (20) up to the upper portion of the housing component, spiraling down through the beer line coil (40) to the lower portion of the housing component (100), traveling in the narrow beer line (60) back up to the shank (10) portion of the faucet (500) at the upper part of the housing component (100) and out through the faucet (500).

FIG. 1 illustrates the back of a beer shank (10) that is part of the faucet (500) which is shown in FIG. 2. The beer shank (10) is approximately 1 inch in diameter. A wider portion of the beer line (60) at the upper end of the housing component (100), with a diameter size of approximately ⅜ inch, connects to this shank (10) so that beer can flow from the keg through the beer line coils (40) and out through the beer faucet (500) located at the front, upper portion of the outer housing component (100).

FIG. 3 is a top view of an exemplary beer dispensing device. The circular base plate (400) rests directly on top of the keg of beer when in use. The support legs (300) are extending from approximately ½inch in from the edge of the base plate (400) are affixed to the housing component (100) in a tri-pod fashion. The support legs (300) are mounted equidistant from each other with one leg being mounted directly under the drip pan (520) to support the drip pan (520) and drip pan mount (530). The wide portion of the beer line (60) is shown to be snug against the inner wall component of the housing component before it is attached to the beer line coil (40) via the upper connector (30) whereby the beer line coil (40) spirals down to the lower portion of the housing component. The wide portion of the beer line comes directly from the keg coupler (200) vertically upwards to the upper end of the housing component (100) before connecting to the beer line coil (40). The narrow portion of the beer line (60) is also shown to vertically extend upwards from the lower portion to the upper portion of the housing component (100) and connected to the back of the beer shank (10).

The shank (10) portion of the beer faucet (500) protrudes into the inner portion of the housing component (100) so that the beer line (20) can connect to the shank (10). A faucet washer (10) is shaped as a hollow ring for inserting the shank (10) portion of the faucet (500) through the hole while the outer, circular edges snugly fits around and over the opening of the housing component (100) in the upper portion where the faucet (500) is positioned. The faucet washer (10) is securely positioned around the shank (10) portion of the faucet on both sides of the housing component (100) to allow for a secure attachment of the shank (10) and faucet (500) to the top, front portion of the housing component (100). The shank (10) and beer faucet (500) are installed about 3 inches down from the top of the housing component (100). Any combination of a beer tap handle (510) and faucet (500) can be used depending on the type of beer used. The drip pan (530) is mounted perpendicularly from the housing component and centered below the faucet (500) to catch and retain any dripping beer from the faucet (500).

The references numbers used in the figures refer to the same or like component parts as described below and illustrated in the figures. However, the materials described in relation to the component parts are not fixed and may vary as described below. For example, component (10) refers to a beer shank and washer which may be made of stainless steel (all grades) or other similar materials. Component (20) refers to a wide beer line which may be made of plastic or rubber (all grades), other similar materials, or a combination of these materials. Component (30), the reducer connector, may be made of steel, stainless steel, aluminum (all grades), other similar materials or a combination of these materials. Component (40), the stainless steel beer coil may be made from any grade of stainless steel, any other similar material, or a combination of these materials. Component (50), the inline beer connector may be made of steel, stainless steel, aluminum (all grades), other similar materials, or a combination of these materials. Component (60), the narrower beer line, may be made of plastic or rubber (all grades), other similar materials, or a combination of these materials. Component (70), the drain plug, may be made of hard plastic (all grades), other similar materials, or a combination of these materials, plastic, rubber (all grades), other similar materials, or a combination of these materials. Component (80), the o-ring seal, may be made of rubber, plastic (all grades), other similar materials, or a combination of these materials. Component (100), the housing component, may be made of stainless steel, carbon steel, hot rolled steel, cold rolled steel, aluminum, hard plastic (all grades), other similar materials, or a combination of these materials. Component (300), the support legs, may be made of stainless steel, steel, aluminum, plastic (all grades), or other similar materials, or a combination of any of these materials. Component part (400), the base plate, may be made of stainless steel, steel, aluminum, plastic (all grades), or other similar materials, or a combination of any of these materials. Components (520) and (530), the drip pan and drip pan mount, respectively, may be made of stainless steel, steel, aluminum, plastic (all grades), other similar materials, or a combination of any of these materials. Component (400) the base plate, may be made of stainless steel, steel, aluminum, plastic (All grades), other similar materials, or a combination of these materials. Where "(all grades)" is listed, this denotes that all varieties of the listed material may be used.

Another embodiment of the present invention, shown in FIGS. 4, 5, 6, 9, and 10, includes an additional faucet and beer line for allowing two different beers to be dispensed from two different kegs at the same time. This version has two beer faucets, two shanks, two beer lines, two beer line coils, and two keg couplers. The additional beer lines and beer line coil are similar to those shown for the single tap version in FIGS. 1, 2, and 3. The additional beer line with the beer line coil is installed within the housing component in the same manner and may contact the existing beer coil. The housing component of the present invention is expanded approximately 1 inch in diameter to accommodate these additional, inner parts. At the bottom of the housing component, there is a secondary water tight hole with a gasket or a similar mechanism through which the second beer line to the secondary coil enters through and leads from the secondary keg that can be placed next to the primary keg. When the secondary beer line is not in use for dispensing beer, the secondary beer line coming out of the device can be stretched out from the housing component and loosely attached to and/or hung on the outer surface of the housing component by using any plastic clamps or similar devices.

Figure 7:
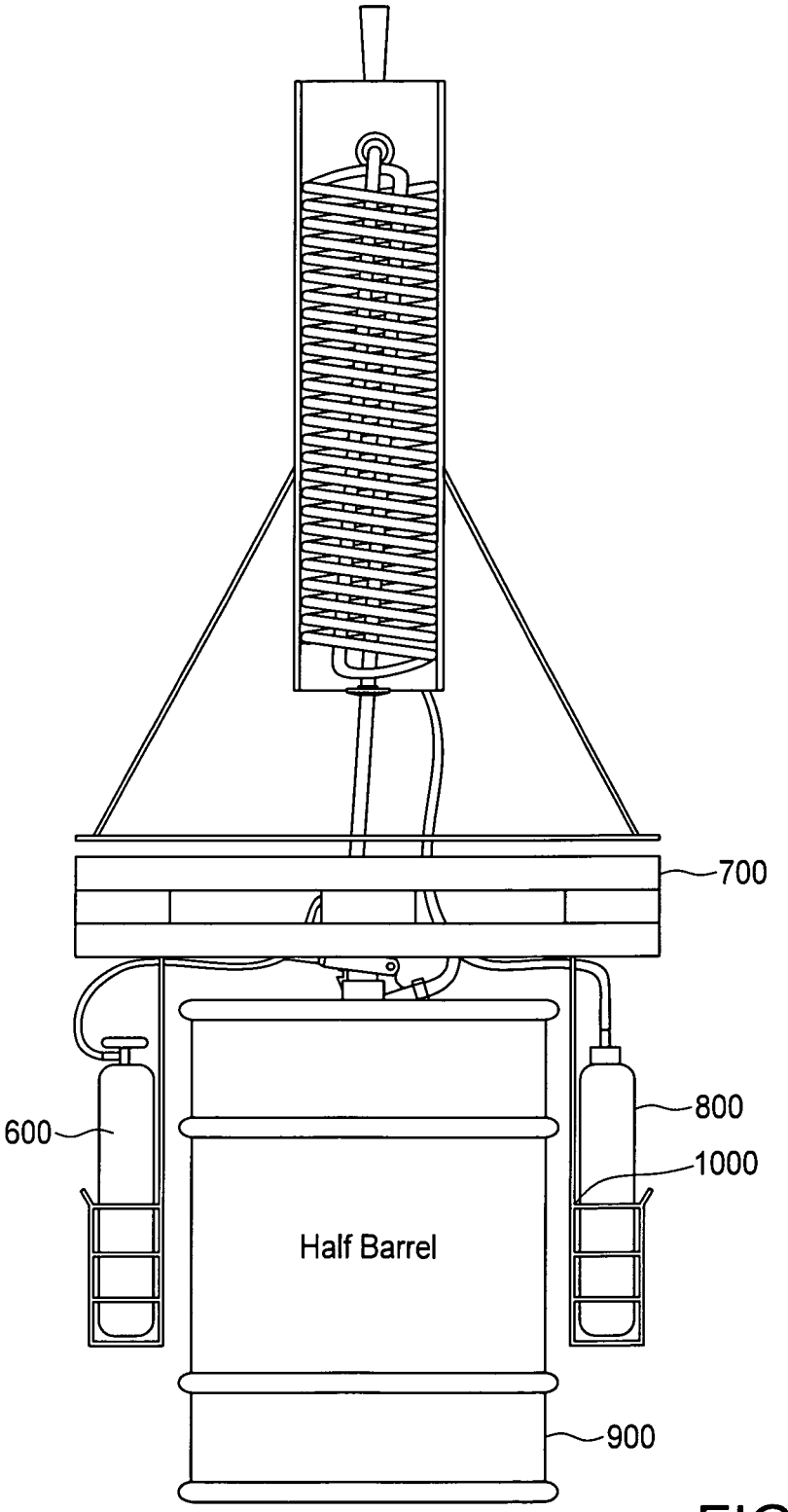
FIG. 7 is a back internal view of single faucet embodiment of the present invention including a spacer plate and a holding component and mounted on top of a keg.
Figure 8:
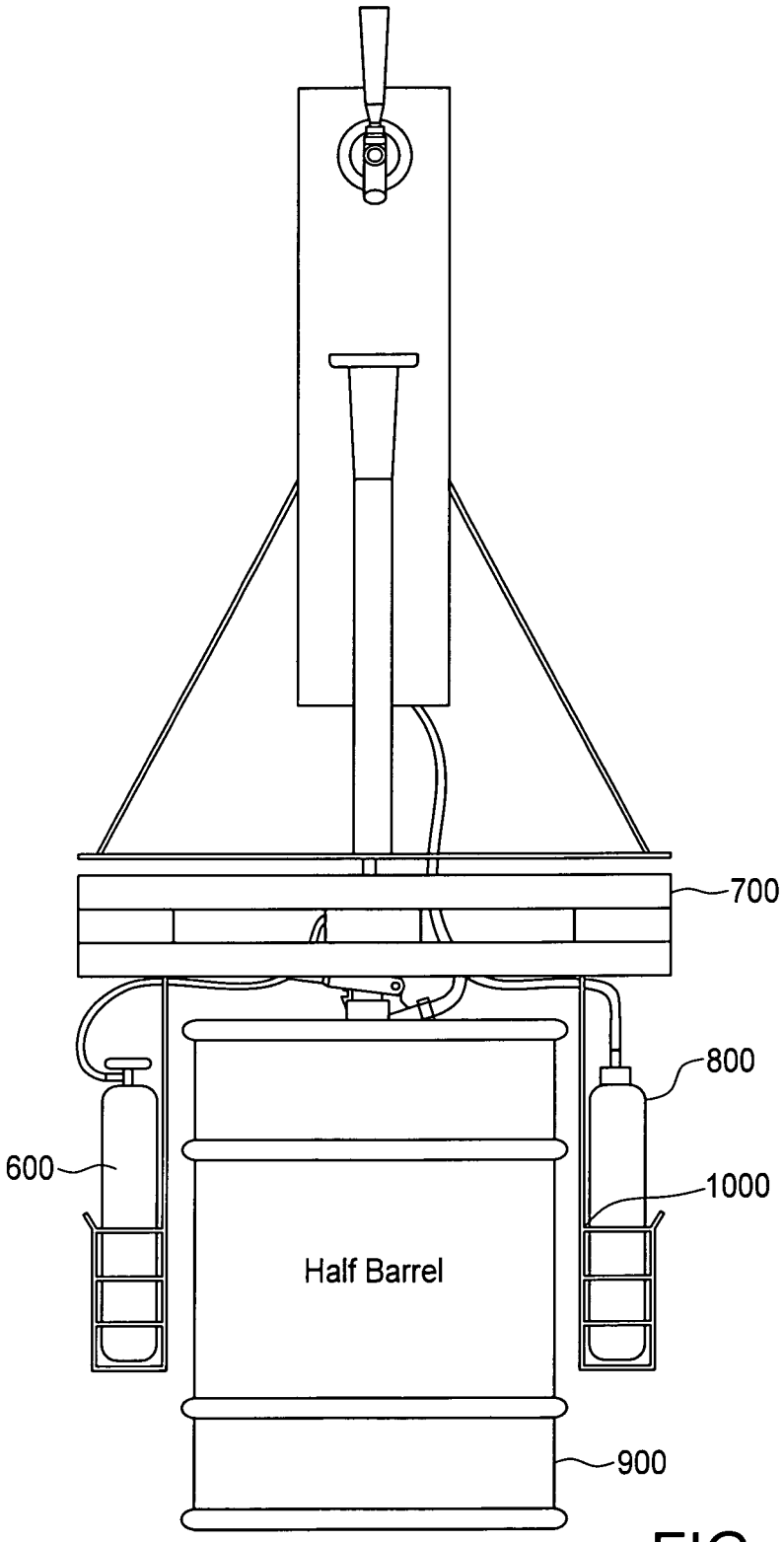
FIG. 8 is a front view of single faucet embodiment of the present invention including a spacer plate and a holding component and mounted on top of a keg.

FIGS. 7 and 8 provide a back internal view and a front view of a single faucet embodiment of the present invention including a spacer plate and a holding device and mounted on top of a keg. Component (600) refers to a gas tank. Component (700) refers to spacer plate which provides space for running beer lines, gas lines, and any drain pail lines from the keg coupler, gas tanks, and drain pail to and from the housing component (100). The optional spacer plate thus consolidates the lines associated with use of the present invention together into a more confined and easily managed space. Additionally, the optional spacer plate provides an additional advantage of raising the housing component of the present invention to a higher height to facilitate beer pouring. Component (800) refers to a drain pail. Component (900) refers to a keg. The keg depicted in FIG. 7 is a half barrel, however any keg size is suitable for use with the present invention. Component (1000) refers to a holding component used to attach the $CO_2$ tank or tanks to a convenient and safe location near the beer keg. As shown, a $CO_2$ tank is placed inside a pocket at one end the holding component hangs on either side of the keg. The holding component (1000) may accommodate placement over and/or around the keg coupler.

Figure 9:
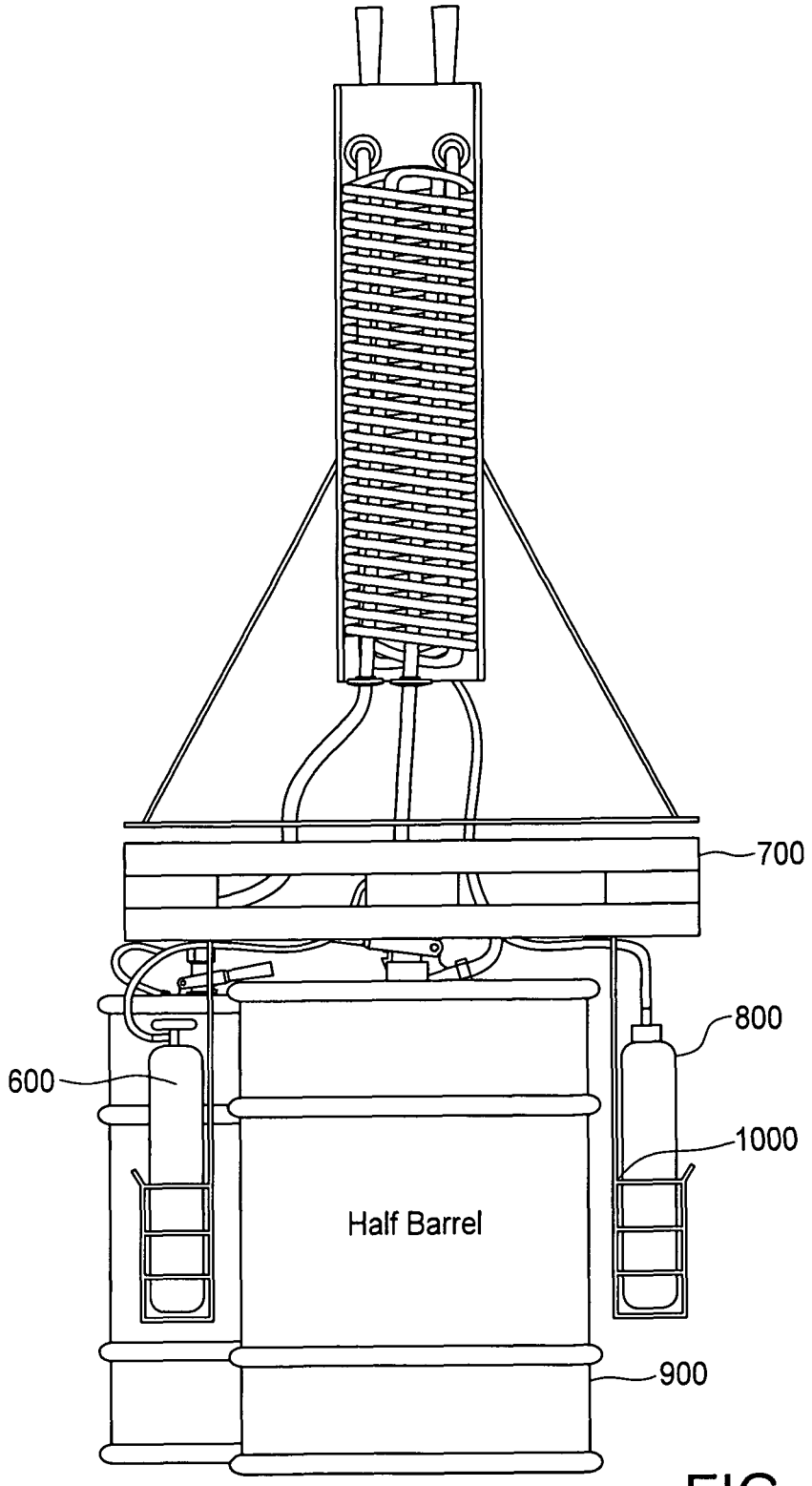
FIG. 9 is a back internal view of double faucet embodiment of the present invention including a spacer plate and a holding component and mounted on top of a half barrel keg.
Figure 10:
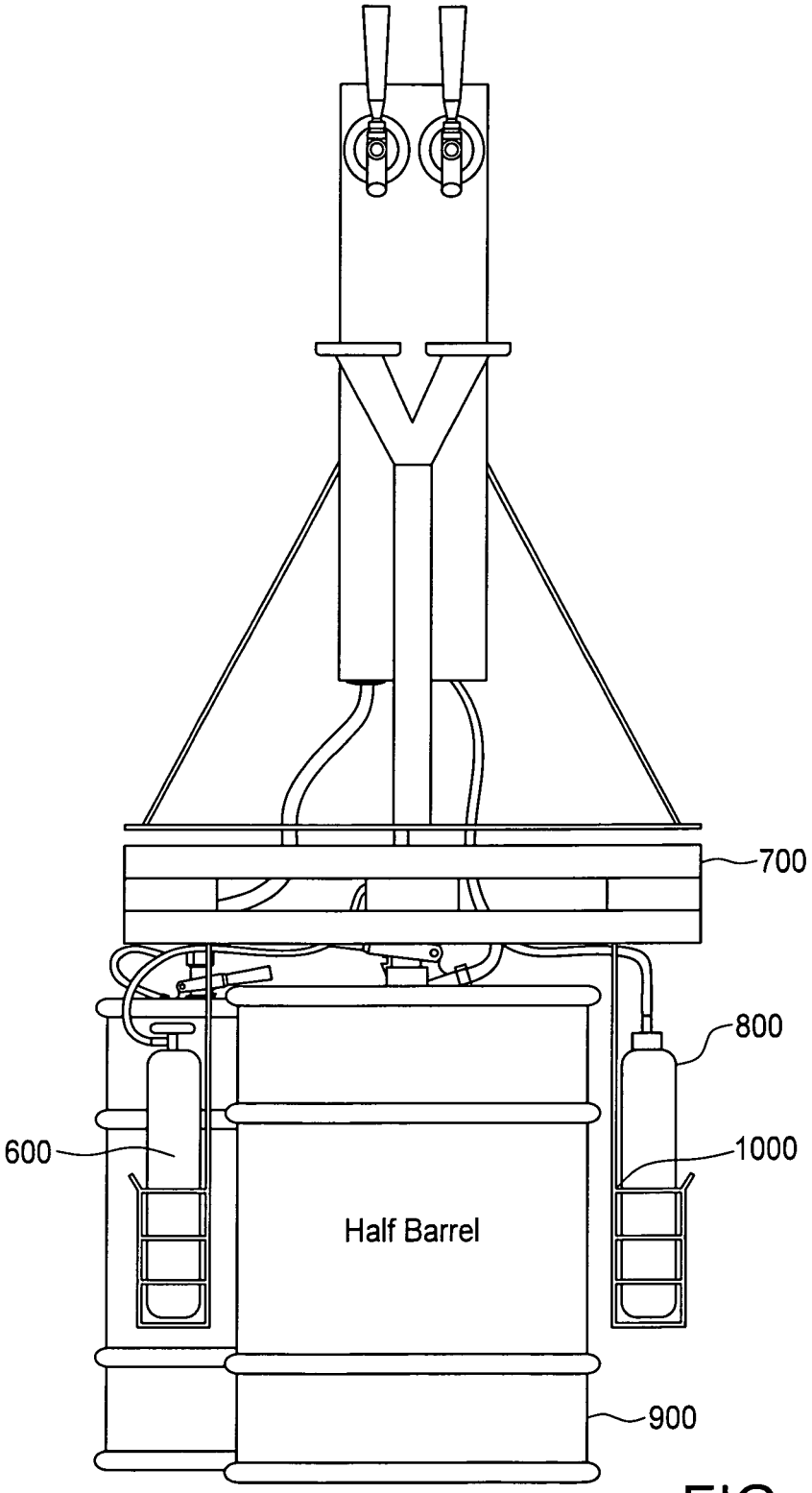
FIG. 10 is a front view of double faucet embodiment of the present invention including a spacer plate and a holding component and mounted on top of a half barrel keg.

FIGS. 9 and 10 provide a back internal view and a front view of a double faucet embodiment of the present invention including a spacer plate and a holding component (1000) as mounted on top of a keg.

Figure 11:
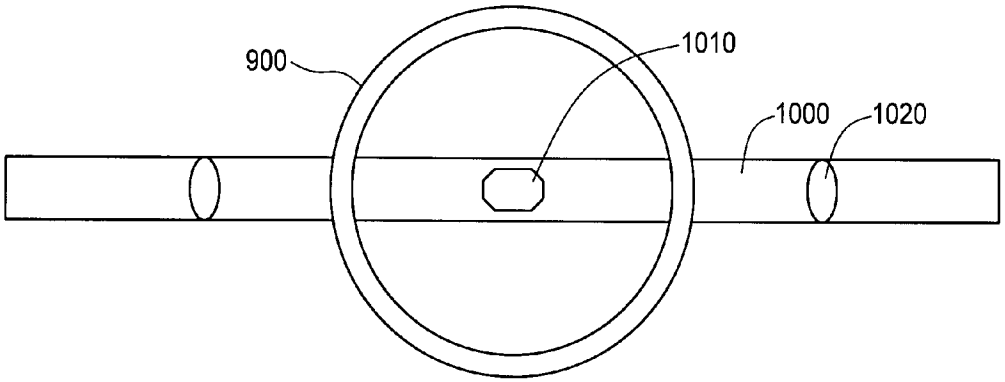
FIG. 11 is top view of a holding component that runs through the handles of the keg, has an opening to slide over the keg coupler, and pockets on each end.

FIG. 11 is top view of a holding component (1000) that may run through the handles of the keg, has an opening (1010) to slide over the keg coupler, and pockets (1020) on each end.

Figure 12:
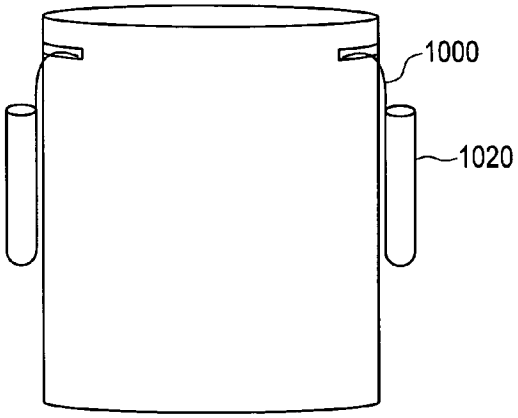
FIG. 12 is a side of a holding component that runs through the handles of the keg, has an opening to slide over the keg coupler, and pockets on each end.

FIG. 12 is a side view of a holding component (1000) that runs through the handles of the keg, has an opening (1010) to slide over the keg coupler, and pockets (1020) on each end.

The descriptions and applications herein are not to be construed as limiting the invention, but as examples and illustrations of the invention.

It should be noted that relative terms (e.g., front and back) are meant to help in the understanding of the technology and are not meant to limit the scope of the invention. Similarly, the term "top" is meant to be relative to the term "bottom." Unless otherwise specified, "and/or" is used similarly (e.g. "A and/or B" includes A, B, A and B, or any combination thereof). The term "includes" means "comprises" (e.g. a device that includes or comprises A and B contains A and B but optionally may contain C or additional components other than A and B). Unless otherwise specified, the singular forms "a," "an," and "the" refer to one or more than one, unless the context clearly dictates otherwise.

The terms, expressions and sizes that have been employed in the foregoing specification are used as terms of description and not of limitation, and are not intended to exclude equivalents of the features shown and described. This application is intended to cover any adaptations or variations of the present invention. It will be appreciated by one of ordinary skill in the art that any arrangement that is calculated to achieve the same purpose may be substituted for the specific embodiment shown. It is also to be understood that the preceding paragraphs are intended to cover all of the generic and specific features of the invention herein described and all statements of the scope of the invention that, as a matter of language, might be said to fall there between.

What is claimed is:

1. A beer dispensing device comprising:

(a) a separate housing component including a beer line and a beer coil, wherein at least a portion of the beer line penetrates a water tight bottom surface of the housing component and that, in use, is exposed between the separate housing component along with at least one of an exposed external keg coupler and an exposed external tri-tap coupler;

(b) a base plate; and (c) multiple spaced support legs, wherein each support leg has a first end mounted to the housing component and a second end connected to the base plate; and wherein the multiple spaced support legs hold the separate housing component above the base plate and the weight of the housing component is supported by the base plate via the multiple spaced support legs.

2. The beer dispensing device of claim 1 wherein the housing component includes a space defined by at least two walls.

3. The beer dispensing device of claim 1 wherein an exterior bottom surface of the housing component base includes a drain plug.

4. The beer dispensing device of claim 1 wherein the housing component includes two beer lines and two beer coils.

5. The beer dispensing device of claim 1 wherein the housing component includes a protruding structure that includes a beer line and extends from the bottom surface of the housing component.

6. The beer dispensing device of claim 5 wherein the housing component and protruding structure contain greater than about 90% of the beer line.

7. The beer dispensing device of claim 1 wherein the housing component contains an interior beer line directly connected to a faucet located near the top of the outside surface of the housing component.

8. The beer dispensing device of claim 1 wherein the beer line and the beer coil each have at least two different widths and are detachable.

9. The beer dispensing device of claim 1 further comprising a spacer plate that provides a space to confine a beer line running to the housing component and a gas line running from the gas tank to the exposed external keg coupler or the exposed external tri-tap coupler.

10. A beer dispensing system comprising:

(a) a separate housing component including a beer line and a beer coil and wherein an exterior bottom surface of the housing component base includes a drain plug, and wherein at least a portion of the beer line is exposed;

(b) a base plate supporting the weight of the housing component and located directly on top of one of either a keg or a spacer plate located directly on top of a keg;

(c) multiple spaced support legs mounted to and holding upright the separate housing component and connected to the base plate;

(d) a keg;

(e) at least one of an exposed external keg coupler and an exposed external tri-tap coupler; and (f) a gas tank.

11. The beer dispensing system of claim 10 further comprising a holding component.

12. The beer dispensing system of claim 10 comprising a spacer plate that provides a space to confine the exposed portion of the beer line running to the separate housing component and a gas line running from the gas tank to the exposed external keg coupler or the exposed external tri-tap coupler.

13. The beer dispensing system of claim 10 further comprising a balance leg.

14. The beer dispensing system of claim 10 wherein the separate housing component base includes a water tight exterior bottom surface comprising the drain plug and a hole permitting passage of the beer line.

15. The beer dispensing system of claim 10 wherein the base plate has at least one non-slip surface and consists of a material selected from stainless steel, chrome plated metal, steel, aluminum, and hard plastic.

16. The beer dispensing system of claim 10 wherein the exposed portion of the beer line is between about two inches and one foot in length.

17. The beer dispensing system of claim 10 including at least two beer lines and two beer coils.

18. A method of using the beer system of claim 10 to produce chilled carbonated beer, wherein the beer is cooled in the housing component after it is drawn from the keg.

19. The beer dispensing system of claim 10 wherein at least one of the housing member components is detachable.

* * * * *